US008437654B2

(12) United States Patent
Ohno

(10) Patent No.: US 8,437,654 B2
(45) Date of Patent: May 7, 2013

(54) SHEET CONVEYING APPARATUS, SHEET CONVEYING METHOD, AND IMAGE FORMING APPARATUS

(75) Inventor: Masahiro Ohno, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 349 days.

(21) Appl. No.: 12/952,454

(22) Filed: Nov. 23, 2010

(65) Prior Publication Data

US 2011/0135333 A1 Jun. 9, 2011

Related U.S. Application Data

(60) Provisional application No. 61/266,635, filed on Dec. 4, 2009, provisional application No. 61/266,646, filed on Dec. 4, 2009.

(51) Int. Cl.
*G03G 21/20* (2006.01)
*G03G 15/00* (2006.01)

(52) U.S. Cl.
USPC ..... 399/94; 399/406

(58) Field of Classification Search ..... 399/94, 399/406
See application file for complete search history.

(56) References Cited

U.S. PATENT DOCUMENTS

| | | | | |
|---|---|---|---|---|
| 7,031,633 | B2 * | 4/2006 | Regan et al. | 399/94 |
| 7,391,987 | B2 * | 6/2008 | Sahara | 399/92 |
| 7,634,211 | B2 * | 12/2009 | Driessen-Olde Scheper et al. | 399/94 |
| 7,787,816 | B2 * | 8/2010 | Kladias et al. | 399/400 |
| 7,832,717 | B2 * | 11/2010 | Sasahara et al. | 270/58.07 |
| 2008/0199229 | A1 | 8/2008 | Fujita et al. | |
| 2011/0064502 | A1 * | 3/2011 | Hase et al. | 399/406 |

FOREIGN PATENT DOCUMENTS

| | | |
|---|---|---|
| JP | 2003-223061 | 8/2003 |
| JP | 2006-072182 | 3/2006 |
| JP | 2006-084791 | 3/2006 |
| JP | 2006-251108 | 9/2006 |

* cited by examiner

*Primary Examiner* — David Gray
*Assistant Examiner* — Gregory H Curran
(74) *Attorney, Agent, or Firm* — Patterson & Sheridan, LLP

(57) ABSTRACT

According to one embodiment, a sheet conveying apparatus includes: a fixing device configured to heat, with a heat roller, a sheet having a toner image transferred thereon and fix a toner on the sheet; a conveying roller arranged downstream of the fixing device and including plural rollers configured to convey the sheet from the fixing device; a heating unit configured to heat the plural rollers of the conveying roller; and a temperature control unit configured to control the heating unit such that the temperature of the plural rollers approaches the toner temperature of the sheet passing through the conveying roller.

20 Claims, 7 Drawing Sheets

SHEET CONVEYING APPARATUS, SHEET CONVEYING METHOD, AND IMAGE FORMING APPARATUS

CROSS-REFERENCE TO RELATED APPLICATION

This application is based upon and claims the priority of U.S. Provisional Application No. 61/266,635, filed on Dec. 4, 2009, and U.S. Provisional Application No. 61/266,646, filed on Dec. 4, 2009, the entire contents of which are incorporated herein by reference.

FIELD

Embodiments described herein relate generally to a sheet conveying apparatus, a sheet conveying method, and an image forming apparatus including the sheet conveying apparatus for heating and fixing a toner transferred onto a sheet and conveying the sheet.

BACKGROUND

In the past, an image forming apparatus heats and fixes a toner after transferring the toner onto a sheet. After the heating and fixing, a conveying roller conveys the sheet to a paper discharge tray, a finisher, or the like. The temperature of the toner on the sheet immediately after being heated and fixed is high. Therefore, the sheet is not instantly cooled. The conveying roller conveys the sheet in the high-temperature state.

In general, the conveying roller includes, on a roller shaft, plural rubber rollers having width smaller than sheet width. The temperature of the rubber rollers is low. When the conveying roller conveys the sheet having the toner not cooled yet, the toner on the sheet comes into contact with the plural rubber rollers and the heat of the toner is deprived by the rubber rollers.

Therefore, a temperature difference occurs in the toner on the sheet between a portion in contact with the rubber rollers and a portion not in contact with the rubber rollers. In other words, a difference occurs in a way of cooling of the toner on the sheet. When the sheet is discharged and the toner is cooled, gloss unevenness occurs on the surface of the sheet. In particular, when an image is printed on, for example, glossy coated coat paper or waterproof paper like a color photograph, a phenomenon of the gloss unevenness conspicuously appears.

DETAILED DESCRIPTION

Figure 1:
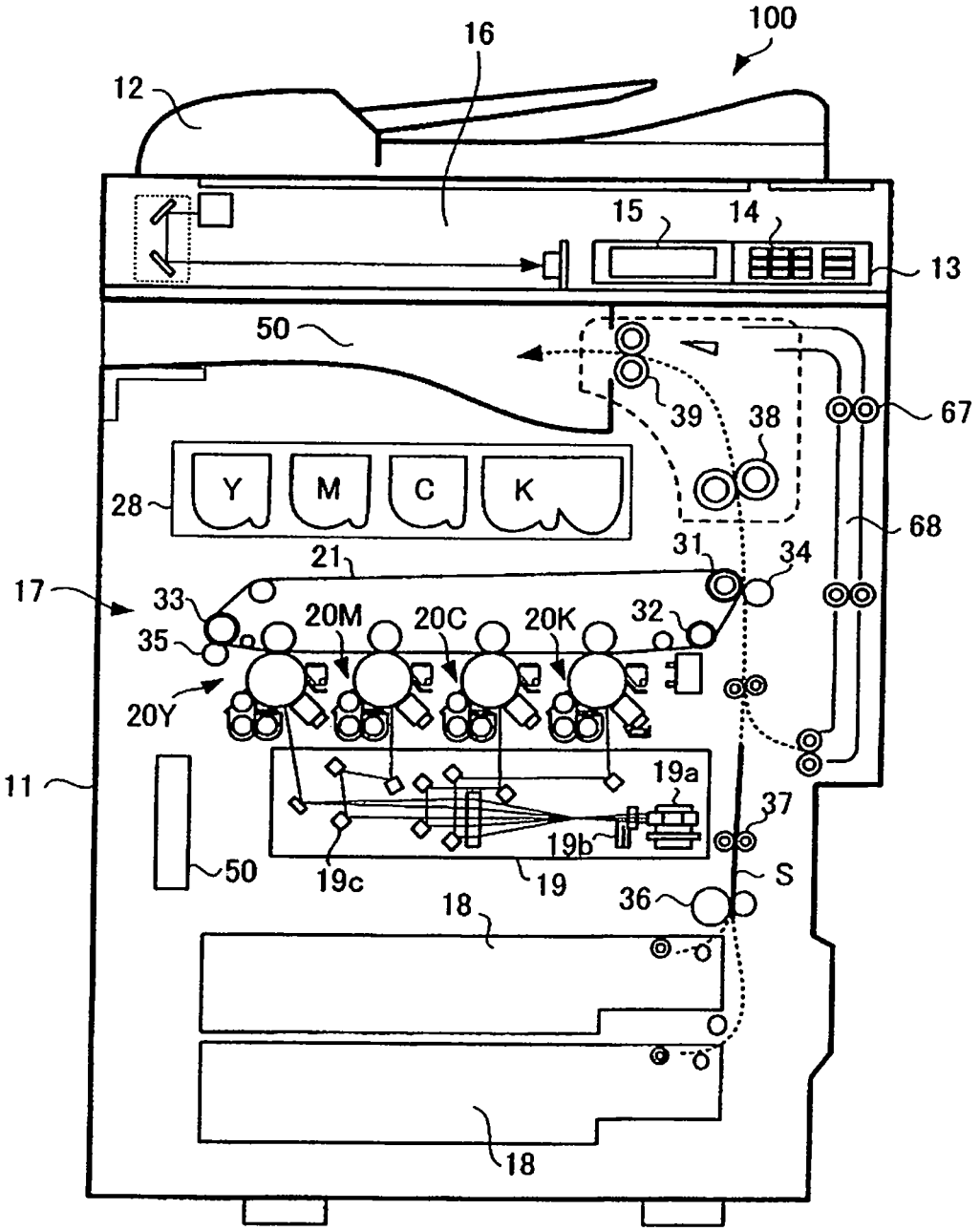
FIG. 1 is an overall diagram of an image forming apparatus according to an embodiment.

In general, according to one embodiment, a sheet conveying apparatus includes: a fixing device configured to heat, with a heat roller, a sheet having a toner image transferred thereon and fix a toner on the sheet; a conveying roller arranged downstream of the fixing device and including plural rollers configured to convey the sheet from the fixing device; a heating unit configured to heat the plural rollers of the conveying roller; and a temperature control unit configured to control the heating unit such that the temperature of the plural rollers approaches toner temperature of the sheet passing through the conveying roller.

An image forming apparatus according to an embodiment is explained in detail below with reference to the accompanying drawings. In the figures, the same components are denoted by the same reference numerals and signs.

FIG. 1 is a diagram of the image forming apparatus according to the embodiment. In FIG. 1, an image forming apparatus 100 is, for example, a MFP (Multi-Function Peripheral) as a complex machine, a printer, or a copying machine. In the following explanation, the MFP is explained as an example.

A document table is provided in an upper part of a main body 11 of the MFP 100. An auto document feeder (ADF) 12 is provided on the document table to freely open and close. An operation panel 13 is provided in the upper part of the main body 11. The operation panel 13 includes an operation unit 14 including various keys and a display unit 15 of a touch panel type.

A scanner unit 16 is provided below the ADF 12 in the main body 11. The scanner unit 16 reads an original document fed by the ADF 12 or an original document placed on the document table and generates image data. The MFP 100 includes a printer unit 17 in the center in the main body 11. The MFP 100 includes plural cassettes 18, which store sheets of various sizes, in a lower part of the main body 11.

The printer unit 17 includes photoconductive drums and a laser. The printer unit 17 processes image data read by the scanner unit 16 or image data created by a PC (Personal Computer) or the like and forms an image on a sheet (details are explained later). The printer unit 17 is, for example, a color laser printer of a tandem system. The printer unit 17 scans photoconductive members with laser beams from an optical scanning device (a laser unit) 19 and generates images.

The printer unit 17 includes image forming units 20Y, 20M, 20C, and 20K for colors of yellow (Y), magenta (M), cyan (C), and black (K). The image forming units 20Y, 20M, 20C, and 20K are arranged in parallel from an upstream side to a downstream side on the lower side of an intermediate transfer belt 21.

Figure 2:
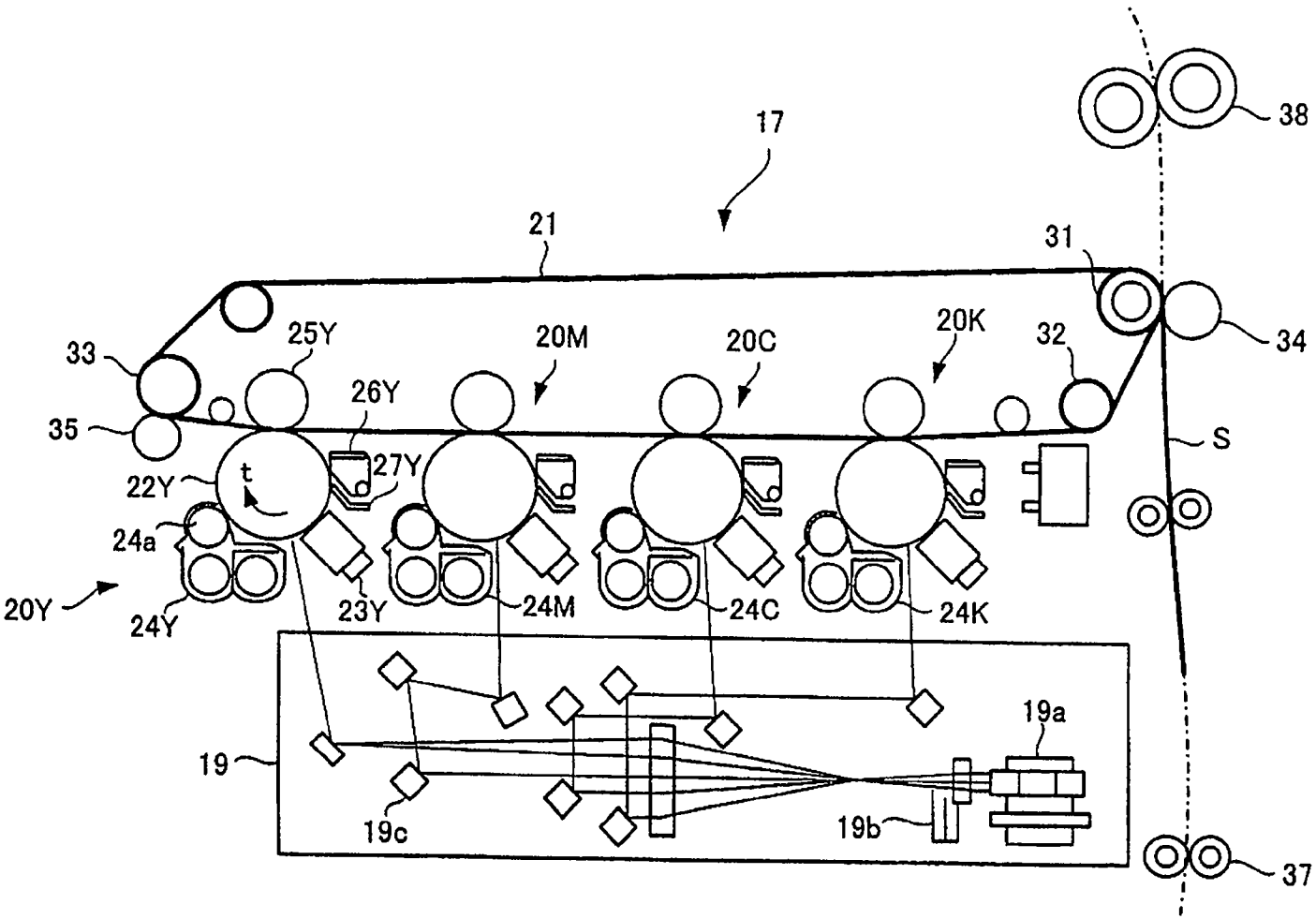
FIG. 2 is an enlarged diagram of an image forming unit included in the image forming apparatus according to the embodiment.

The printer unit 17 including the image forming units 20Y, 20M, 20C, and 20K are shown in FIG. 2 in enlargement. In the following explanation, since the image forming units 20Y, 20M, 20C, and 20K have the same configuration, the image forming unit 20Y is explained as a representative.

As shown in FIG. 2, the image forming unit 20Y includes a photoconductive drum 22Y as an image bearing member.

An electrifying charger 23Y, a developing device 24Y, a primary transfer roller 25Y, a cleaner 26Y, a blade 27Y, and the like are arranged around the photoconductive drum 22Y along a rotating direction t. The image forming unit 20Y irradiates a yellow laser beam from the optical scanning device 19 on an exposure position of the photoconductive drum 22Y and forms an electrostatic latent image on the photoconductive drum 22Y.

The electrifying charger 23Y of the image forming unit 20Y uniformly charges the entire surface of the photoconductive drum 22Y. The developing device 24Y supplies, with a developing roller 24*a* to which development bias is applied, a two-component developer containing a yellow toner and a carrier to the photoconductive drum 22Y. The cleaner 26Y removes a residual toner on the surface of the photoconductive drum 22Y using the blade 27Y.

As shown in FIG. 1, a toner cartridge 28 configured to supply toners to developing devices 24Y to 24K is provided above the image forming units 20Y to 20K. The toner cartridge 28 includes toner cartridges of colors of yellow (Y), magenta (M), cyan (C), and black (K).

The intermediate transfer belt 21 rotates in a cyclical manner. As a material of the intermediate transfer belt 21, for example, semi-conductive polyimide is used from the viewpoint of heat resistance and abrasion resistance. The intermediate transfer belt 21 is stretched and suspended around a driving roller 31 and driven rollers 32 and 33. The intermediate transfer belt 21 is opposed to and in contact with photoconductive drums 22Y to 22K. The primary transfer roller 25Y applies a primary transfer voltage to a position of the intermediate transfer belt 21 opposed to the photoconductive drum 22Y and primarily transfers a toner image on the photoconductive drum 22Y onto the intermediate transfer belt 21.

A secondary transfer roller 34 is arranged to be opposed to the driving roller 31 that stretches and suspends the intermediate transfer belt 21. When a sheet S passes between the driving roller 31 and the secondary transfer roller 34, the secondary transfer roller 34 applies a secondary transfer voltage to the sheet S and secondarily transfers the toner image on the intermediate transfer belt 21 onto the sheet S. A belt cleaner 35 is provided near the driven roller 33 of the intermediate transfer belt 21.

The optical scanning device 19 scans a laser beam, which is emitted from a semiconductor laser element, in an axis direction of the photoconductive drums 22. The optical scanning device 19 includes a polygon mirror 19*a*, an imaging lens system 19*b*, and a mirror 19*c*.

As shown in FIG. 1, a separation roller 36 configured to extract the sheet S in the paper feeding cassettes 18 and conveying rollers 37 are provided between the paper feeding cassettes 18 and the secondary transfer roller 34. A fixing device 38 is provided downstream of the secondary transfer roller 34. A conveying roller 39 is provided downstream of the fixing device 38. The conveying roller 39 discharges the sheet S to a paper discharge unit 50.

Further, a reversing conveying path 68 including conveying rollers 67 is provided downstream of the fixing device 38. The reversing conveying path 68 reverses the sheet S and leads the sheet S in the direction of the secondary transfer roller 34. The reversing conveying path 68 is used when duplex printing is performed.

A finisher may be arranged adjacent to the image forming apparatus 100. The image forming apparatus 100 that can be coupled to the finisher further includes another conveying roller downstream of the conveying roller 39 and discharges the sheet S to the finisher. The finisher staples sheets, punches the sheets, or folds the sheets into two and discharges the sheets.

The operation of the image forming apparatus 100 shown in FIGS. 1 and 2 is explained. When image data is input from the scanner unit 16, the PC, or the like, the image forming units 20Y to 20K sequentially form images.

When the image forming unit 20Y is explained as an example, a laser beam corresponding to image data of yellow (Y) is irradiated on the photoconductive drum 22Y and an electrostatic latent image is formed thereon. The developing device 24Y develops the electrostatic latent image on the photoconductive drum 22Y to form a toner image of yellow (Y).

The photoconductive drum 22Y comes into contact with the rotating intermediate transfer belt 21 and transfers, with the primary transfer roller 25Y, the toner image of yellow (Y) onto the intermediate transfer belt 21. After the photoconductive drum 22Y primarily transfers the toner image onto the intermediate transfer belt 21, the cleaner 26Y and the blade 27Y remove a residual toner on the photoconductive drum 22Y to enable the next image formation.

In the same manner as the yellow (Y) toner image forming process, the image forming units 20M to 20K form toner images of magenta (M), cyan (C), and black (B). The toner images are sequentially transferred to the same position as the toner image of yellow (Y) on the intermediate transfer belt 21. The toner images of yellow (Y), magenta (M), cyan (C), and black (K) are multiply transferred onto the intermediate transfer belt 21 to obtain a full-color toner image.

The intermediate transfer belt 21 collectively secondarily transfers the full-color toner image onto the sheet S with transfer bias of the secondary transfer roller 34. In synchronization with the full-color toner image on the intermediate transfer belt 21 reaching the secondary transfer roller 34, the sheet S is supplied from the paper feeding cassette 18 to the secondary transfer roller 34.

The sheet S having the toner image secondarily transferred thereon reaches the fixing device 38 and the toner image is fixed. The conveying roller 39 discharges the sheet S having the toner image fixed thereon to the paper discharging unit 50. After the secondary transfer ends, the belt cleaner 35 cleans a residual toner on the intermediate transfer belt 21.

Figure 3:
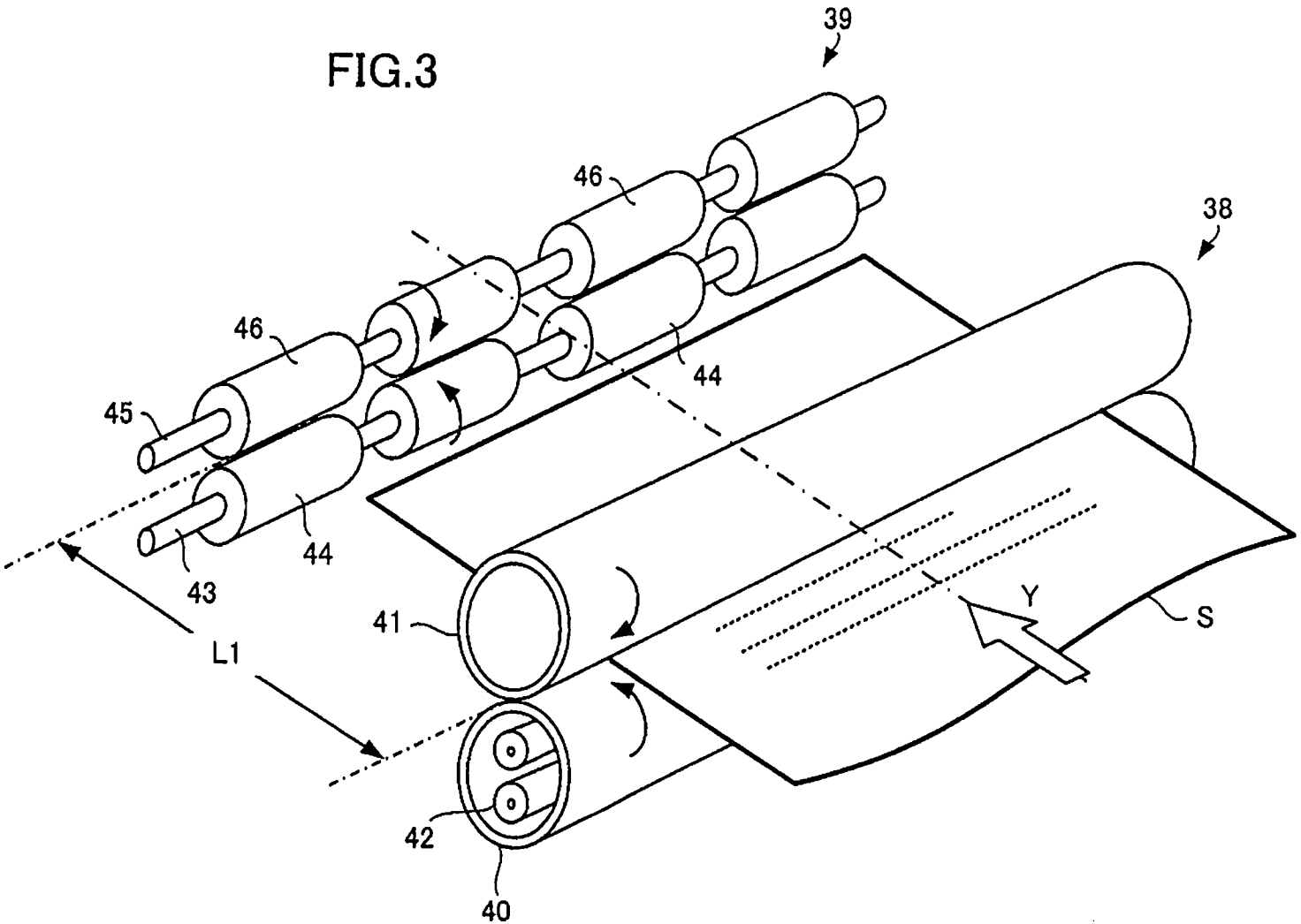
FIG. 3 is a perspective view of the configuration of a fixing device and a conveying roller included in the image forming apparatus according to the embodiment.

FIG. 3 is a perspective view of the configuration of the fixing device 38 and the conveying roller 39. A route reaching from the fixing device 38 to the conveying roller 39 is bent as shown in FIG. 1. However, in FIG. 3, for convenience of illustration, it is assumed that the sheet S is linearly conveyed.

The fixing device 38 includes a heat roller 40 and a pressing roller 41. The heat roller 40 and the pressing roller 41 are formed in a cylindrical shape. The pressing roller 41 is brought into contact with the heat roller 40 to rotate the heat roller 40 and the pressing roller 41, whereby the heat roller 40 and the pressing roller 41 nip and convey the sheet S. The heat roller 40 includes a heater 42. As the heater 42, for example, IH (Induction Heating) or a halogen lamp is used. The fixing device 38 and the conveying roller 39 are spaced apart a distance L1. The sheet S having a toner heated and fixed thereon by the fixing device 38 is conveyed downstream passing through the conveying roller 39.

On the other hand, the conveying roller 39 includes a pair of plural rollers arranged to be opposed to one another. The conveying roller 39 includes a lower roller formed by attaching plural rubber rollers 44 to a roller shaft 43 orthogonal to a conveying direction of the sheet S and an upper roller formed by attaching plural rubber rollers 46 to a roller shaft 45 orthogonal to the conveying direction. The lower roller and the upper roller are rotated, whereby the conveying roller 39 conveys the sheet S while nipping the sheet S between the lower roller and the upper roller. The toner on the sheet S immediately after being heated by the fixing device 38 is not instantly cooled and is conveyed by the conveying roller 39 in a high-temperature state.

When the sheet S having the high temperature of the toner comes into contact with the plural rubber rollers 44 of the conveying roller 39, since the temperature of the rubber rollers 44 is lower than the temperature of the toner on the sheet S, the heat of the toner is deprived. Therefore, a temperature difference occurs between a portion in contact with the rubber rollers 44 and a portion not in contact with the rubber rollers 44 and a difference occurs in a way of cooling of the toner.

If the difference occurs in the way of cooling of the toner, when the toner is cooled, the gloss of a printing surface of the sheet S is different and gloss unevenness occurs. In particular, when an image is printed on, for example, glossy coated coat paper or waterproof paper like a color photograph, the gloss unevenness is conspicuous and streak-like gloss unevenness occurs.

A sheet conveying apparatus according to the embodiment adjusts the temperature of the conveying roller 39 to reduce the temperature difference between the portion in contact with the rubber rollers 44 and the portion not in contact with the rubber rollers 44 when the sheet S passes the conveying roller 39.

The configuration of a main part of the sheet conveying apparatus according to the embodiment is explained below with reference to FIG. 4.

Figure 4:
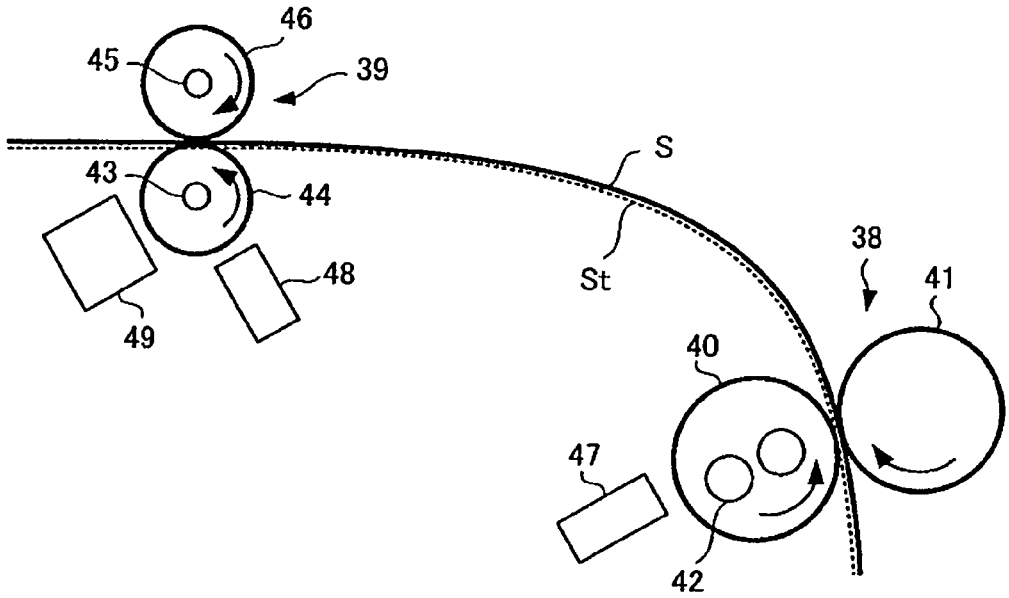
FIG. 4 is a diagram of a main part of a sheet conveying apparatus according to the embodiment.

In FIG. 4, the conveying roller 39 is arranged downstream of the fixing device 38. The sheet S is conveyed such that a surface of the sheet S to which a toner St adheres comes into contact with the heat roller 40 of the fixing device 38 and the lower roller (the rubber rollers 44) of the conveying roller 39. A temperature sensor 47 is attached in a position near the heat roller 40. A temperature sensor 48 is attached in a position near the rubber rollers 44 of the conveying roller 39. A heater 49 configured to warm the rubber rollers 44 is provided. The heater 49 configures a heating unit. The heater 49 warms the plural rubber rollers 44 in contact with the toner surface of the sheet S.

The heater 49 includes a lamp arranged to extend in parallel to the roller shaft 43 to simultaneously warm the plural rubber rollers 44. Alternatively, one heater may be arranged for each of the plural rubber rollers 44.

The temperature sensor 47 detects the temperature of the heat roller 40. The temperature sensor 48 detects the temperature of the rubber rollers 44. Detection results of the temperature sensors 47 and 48 are sent to a control unit (explained later) and used for temperature adjustment of the heaters 42 and 49. The control unit controls the temperature of the toner St of the sheet S passes through the conveying roller 39 and the temperature of the rubber rollers 44 to be substantially equal.

Figure 5A:
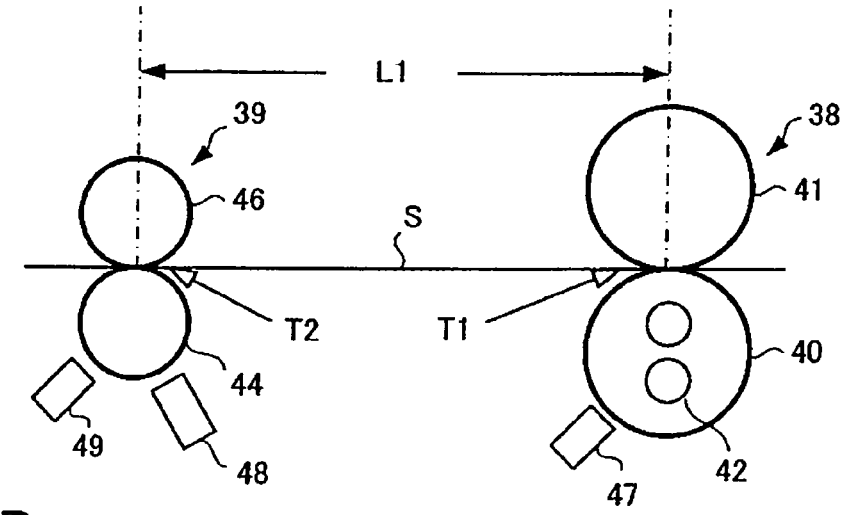
FIG. 5A is a diagram for explaining toner temperature of a sheet in the sheet conveying apparatus according to the embodiment.
Figure 5B:
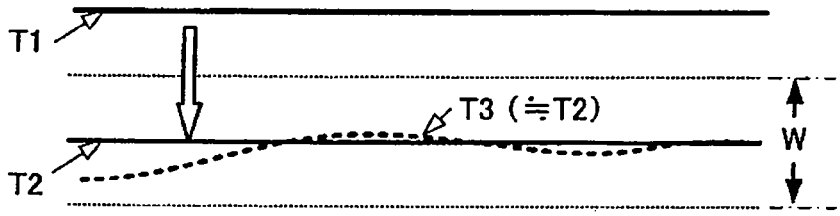
FIG. 5B is a diagram for explaining the operation of temperature control by the sheet conveying apparatus according to the embodiment.

FIGS. 5A and 5B are diagrams for explaining the operation of the temperature adjustment for the heat roller 40 and the rubber rollers 44.

The temperature of the toner St of the sheet S passing through the fixing device 38 and the temperature of the toner St of the sheet S passing through the conveying roller 39 are shown in FIG. 5A. Toner temperature of the sheet S immediately after passing through the fixing device 38 is represented as T1. Then, since there is a distance L1 to the conveying roller 39, toner temperature of the sheet S reaching the conveying roller 39 is T2 slightly lower than T1. The temperature T2 can be obtained by calculation on the basis of the distance L1 between the fixing device 38 and the conveying roller 39. In other words, a temperature fall t0 due to conveyance by the distance L1 is calculated from the temperature T1 and the temperature T2 can be obtained by calculation T2=(T1−t0). Alternatively, the temperature T2 may be assumed from an empirical rule.

The temperature sensor 47 detects the surface temperature of the heat roller 40. The control unit controls the temperature of the heater 42 on the basis of a detection result of the temperature sensor 47 and adjusts the temperature of the toner St immediately after passing through the fixing device 38 to be T1. The temperature sensor 48 detects the surface temperature of the rubber rollers 44. The control unit controls the temperature of the heater 49 and adjusts the temperature of the rubber rollers 44 to be the same as T2.

The toner temperature T1 of the sheet S immediately after passing through the fixing device 38 and the toner temperature T2 of the sheet S reaching the conveying roller 39 are shown in FIG. 5B. The temperatures T1 and T2 are equivalent to detected temperatures of the temperature sensors 47 and 48 and substantially fixed by the temperature control. On the other hand, the temperature of the rubber rollers 44 is usually lower than toner temperature. However, the temperature rises when the rubber rollers 44 are heated by the heater 49. The temperature sensor 48 detects the surface temperature of the rubber rollers 44. The control unit controls the temperature of the heater 49 such that the surface temperature of the rubber rollers 44 approaches T2.

The detected temperature of the temperature sensor 48 is represented as T3. When the detected temperature T3 is lower than the temperature T2, the control unit controls the temperature of the heater 49 to be higher. When the detected temperature T3 of the temperature sensor 48 is higher than the temperature T2, the control unit controls the temperature of the heater 49 to be lower and adjusts the temperature of the heater 49 to be within a temperature range W set in advance.

Therefore, when the sheet S passes through the conveying roller 39, the temperature of the rubber rollers 44 and the temperature of the toner St on the sheet S are substantially equal. Therefor, the heat of the toner St is not deprived by the contact with the rubber rollers 44. The gloss of the printing surface of the sheet S is substantially equal over the entire surface and possible to suppress gloss unevenness.

Figure 6:
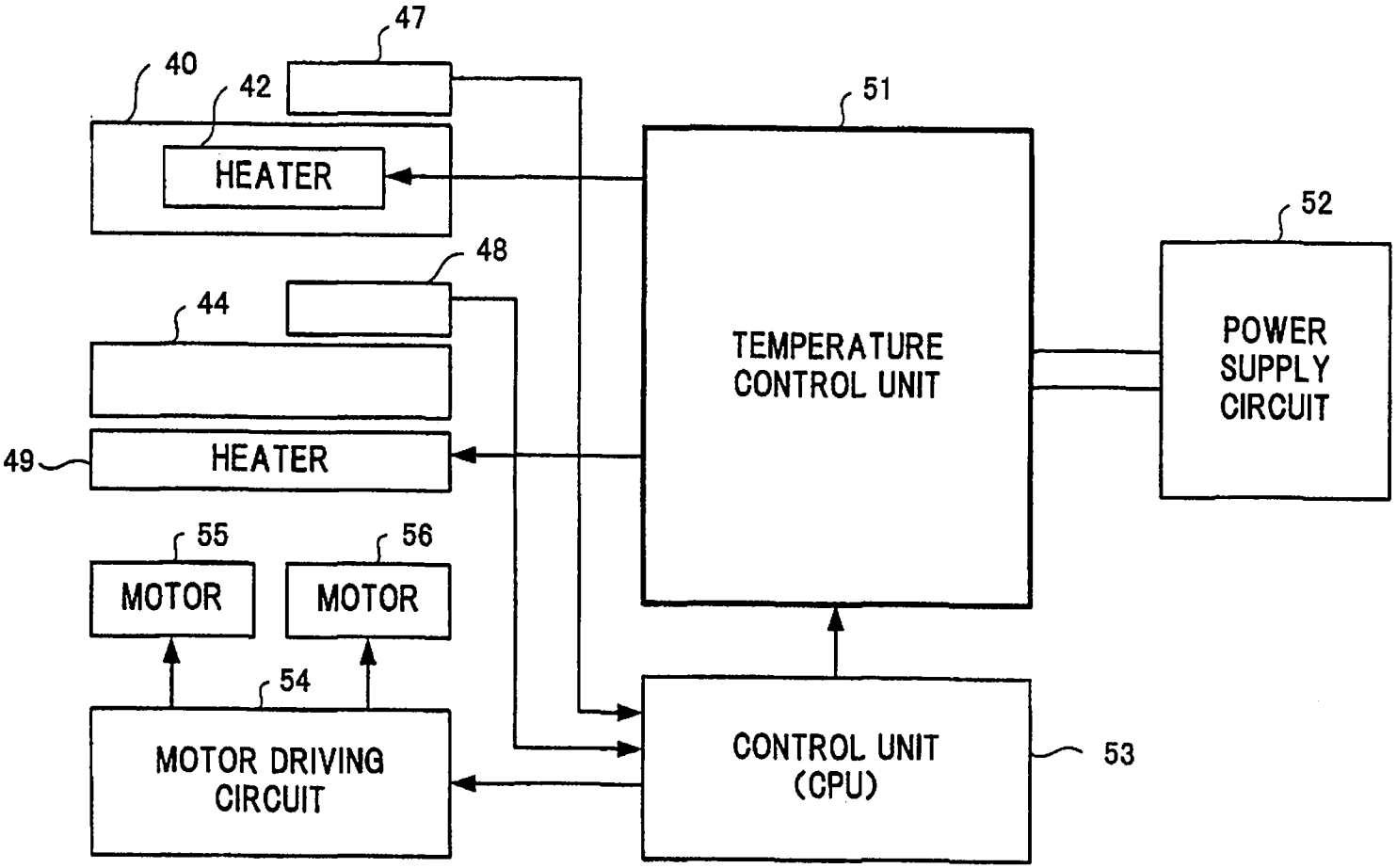
FIG. 6 is a block diagram of a control system of the sheet conveying apparatus according to the embodiment.

FIG. 6 is a block diagram of a control system of the sheet conveying apparatus. The control system shown in FIG. 6 includes a temperature control unit 51, a power supply circuit 52, a control unit 53, and a motor driving circuit 54.

The temperature control unit 51 performs the temperature control for the heaters 42 and 49. The heater 42 includes plural heaters configured to respectively heat the center and peripheral sections of the heat roller 40. The temperature control unit 51 supplies an AC voltage (e.g., AC 100 volts) from the power supply circuit 52 to the heater 42 and heats the heater 42. The heater 49 heats the rubber rollers 44. The temperature control unit 51 supplies an AC voltage (e.g., AC 100 volts) from the power supply circuit 52 to the heater 49 and heats the heater 49.

The temperature sensor 47 is attached near the heat roller 40. The temperature sensor 47 is, for example, a thermistor. The temperature sensor 47 detects the surface temperature of the heat roller 40 and supplies a detection result to the control unit 53. The temperature sensor 48 is attached near the rubber rollers 44. The temperature sensor 48 detects the surface temperature of the rubber rollers 44 and supplies a detection result to the control unit 53.

The control unit 53 includes a microprocessor including a CPU. Temperature detection results of the temperature sensors 47 and 48 are input to the control unit 53. The control unit 53 controls the temperature control unit 51 on the basis of the temperature detection results of the temperature sensors 47 and 48 and controls the temperatures of the heaters 42 and 49. A method of the control of the temperatures is as explained with reference to FIG. 5B. Specifically, the temperature control unit 51 controls the temperature of the heater 42 such that the toner temperature of the sheet S immediately after passing through the fixing device 38 reaches T1. The temperature control unit 51 controls the temperature of the heater 49 such that the toner temperature of the sheet S passing through the conveying roller 39 approaches T2.

The control unit 53 controls the motor driving circuit 54. The motor driving circuit 54 controls a motor 55 to drive to rotate the heat roller 40 and the pressing roller 41 of the fixing device 38. The motor driving circuit 54 controls a motor 56 to drive to rotate the conveying roller 39.

Figure 7:
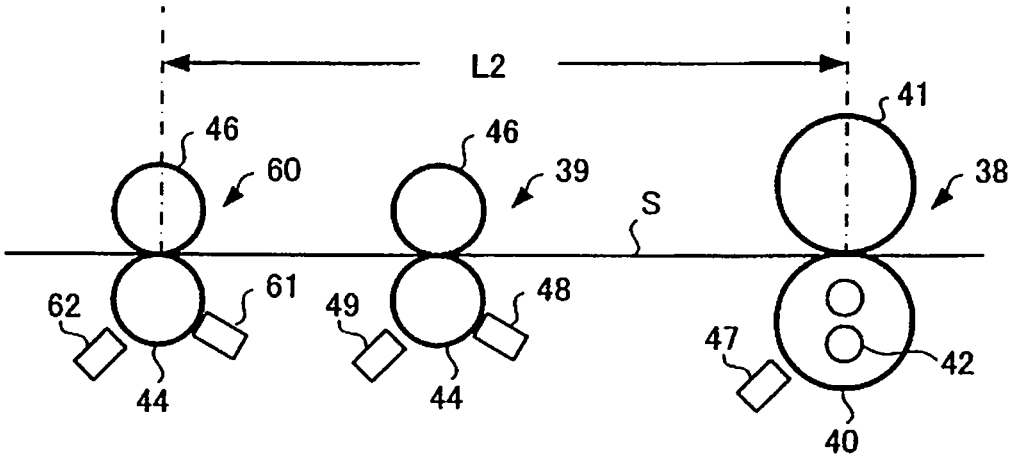
FIG. 7 is a diagram of a modification of the sheet conveying apparatus according to the embodiment.

FIG. 7 is a diagram of a modification of the sheet conveying apparatus. In FIG. 7, plural rows of conveying rollers are arranged downstream of the fixing device 38. An example is assumed in which a conveying roller 60 is further present downstream of the conveying roller 39 to discharge the sheet S to the finisher.

When the sheet S passes through the conveying roller and reaches the conveying roller 60, the toner temperature of the sheet S further falls. Therefore, a temperature sensor 61 configured to detect the temperature of the rubber rollers 44 of the conveying roller 60 and a heater 62 configured to heat the rubber rollers 44 of the conveying roller 60 are provided.

The toner temperature of the sheet S immediately after passing through the fixing device 38 is represented as T1. Since there is a distance L2 to the conveying roller 60, toner temperature of the sheet S reaching the conveying roller 60 is lower than the temperature T2 of the sheet S passing through the conveying roller 39. The temperature of the toner of the sheet S reaching the conveying roller 60 is represented as, for example, temperature T4. The temperature T4 can be obtained by calculation on the basis of the distance L2 between the fixing device 38 and the conveying roller 60. The temperature sensor 61 detects the surface temperature of the rubber rollers 44 of the conveying roller 60. The control unit 53 controls the temperature of the heater 62 and adjusts the temperature of the rubber rollers 44 to approach T4.

Even when the plural rows of conveying rollers are present as shown in FIG. 7, when the sheet S passes through each of the conveying rollers 39 and 60, the temperature of the rubber rollers 44 and the toner temperature on the sheet S are substantially equal. Therefore, the heat of the toner is not deprived by the contact with the rubber rollers 44. When the plural rows of conveying rollers are present unnecessary to heat all the conveying rollers, advisable to heat at least the conveying roller 39 closest to the fixing device 38.

As another modification, the rubber rollers 46 included in the upper roller of the conveying roller 39 (or 60) may be heated by a heater. The conveying rollers 67 (FIG. 1) provided in the reversing conveying path 68 may be heated.

Therefore, in the sheet conveying apparatus according to the embodiment, the gloss of the printing surface of the sheet S is substantially equal over the entire surface, and possible to suppress gloss unevenness.

Figure 8:
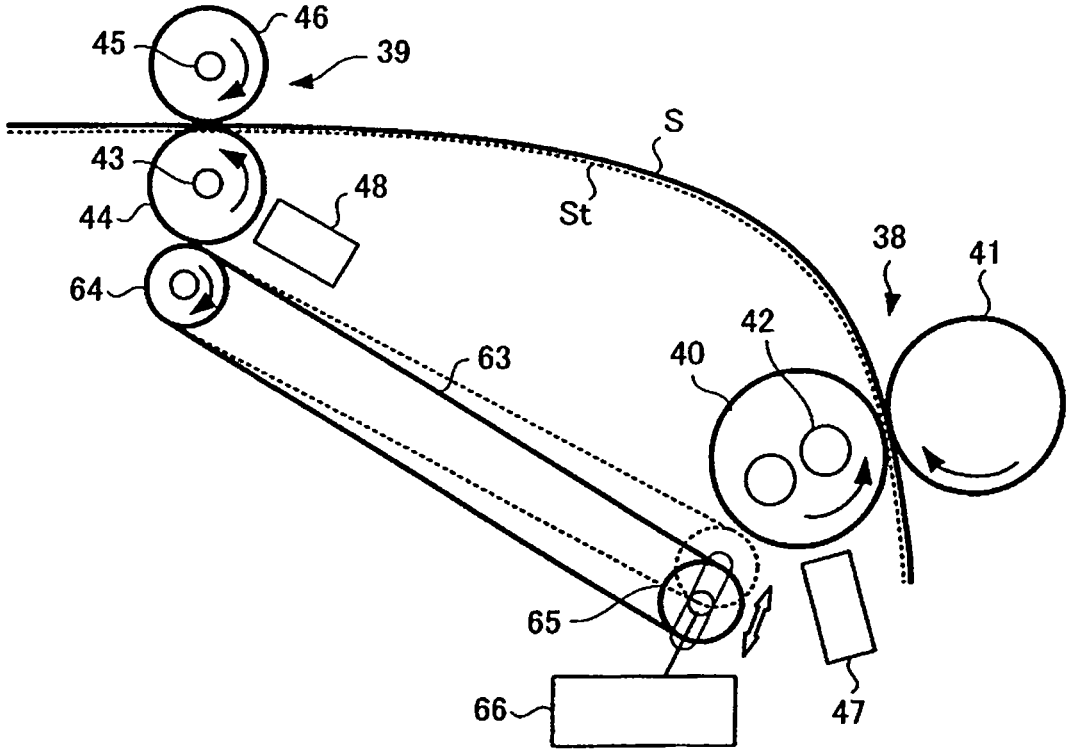
FIG. 8 is a diagram of a main part of a sheet conveying apparatus according to a second embodiment.

FIG. 8 is a diagram of a sheet conveying apparatus according to a second embodiment. In FIG. 8, the conveying roller 39 is arranged downstream of the fixing device 38 at a distance from the fixing device 38. The sheet S is conveyed such that a surface of the sheet S to which the toner St adheres comes into contact with the heat roller 40 of the fixing device 38 and the rubber rollers 44 of the conveying roller 39. The temperature sensor 47 is attached in a position near the heat roller 40. The temperature sensor 48 is attached in a position near the rubber rollers 44.

Figure 9:
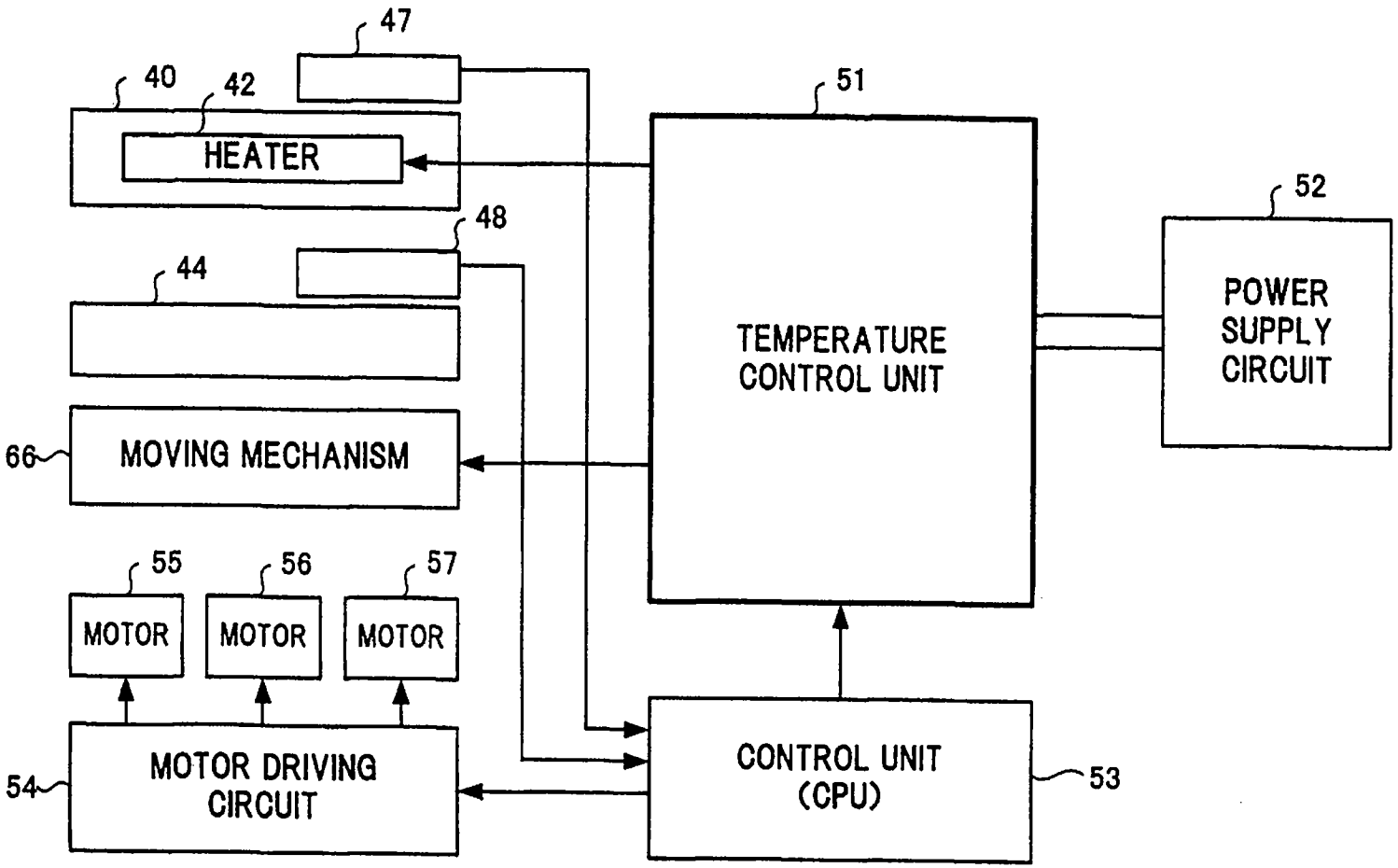
FIG. 9 is a block diagram of a control system of the sheet conveying apparatus according to the second embodiment.

A heating belt 63 is provided in contact with the rubber rollers 44. The heating belt 63 configures a heating unit. The heating belt 63 is suspended between a roller 64 and a roller 65 and formed in a loop shape. The roller 64 is provided near the rubber rollers 44. The roller 65 is moved close to and away from the heat roller 40 by a moving mechanism 66. The moving mechanism 66 configures the heating unit together with the heating belt 63. The roller 64 is rotated by a motor 57 (FIG. 9). Alternatively, the roller 64 may be rotated by using the torque of the motor 56 configured to drive to rotate the conveying roller 39.

One end of a loop of the heating belt 63 is set in contact with the rubber rollers 44. The other end of the loop of the heating belt 63 is provided near the heat roller 40. Therefore, the heating belt 63 receives heat from the heat roller 40 and transfers the heat of the heating belt 63 to the rubber rollers 44.

The temperature sensor 47 detects the temperature of the heat roller 40, and a detection result uses the temperature control for the heater 42. The temperature sensor 48 detects the temperature of the rubber rollers 44, and moves the roller 65 close to or away from the heat roller 40 according to a detection result to thereby control the temperature of the heat belt 63. The heat of the heating belt 63 is transferred to the rubber rollers of the conveying roller 39 to adjust the toner temperature of the sheet S passing through the conveying roller 39 and the temperature of the rubber rollers 44 to be substantially equal.

Specifically, if the detected temperature T3 of the temperature sensor 48 is lower than the temperature T2, the control unit 53 moves the roller 65 close to the heat roller 40 to raise the temperature of the heating belt 63. If the detected temperature T3 of the temperature sensor 48 is higher than the temperature T2, the control unit 53 moves the roller 65 away from the heat roller 40 to lower the temperature of the heating belt 63. Therefore possible to perform temperature control same as that shown in FIG. 5B.

FIG. 9 is a block diagram of the control system of the sheet conveying apparatus according to the second embodiment. The control system includes the temperature control unit 51, the power supply circuit 52, the control unit 53, and the motor driving circuit 54.

The temperature control circuit 51 performs temperature control for the heater 42 and the rubber rollers 44 of the conveying roller 39. The temperature control unit 51 supplies an AC voltage (e.g., AC 100 volts) from the power supply circuit 52 to the heater 42 and heats the heater 42. The temperature control circuit 51 controls the moving mechanism 66, moves the roller 65 close to and away from the heat roller 40 to control the temperature of the heating belt 63, and adjusts the temperature of the rubber rollers 44.

The temperature sensor 47 is attached near the heat roller 40. The temperature sensor 47 detects the surface temperature of the heat roller 40 and supplies a detection result to the control unit 53. The temperature sensor 48 is attached near the rubber rollers 44. The temperature sensor 48 detects the surface temperature of the rubber rollers 44 and supplies a detection result to the control unit 53.

The control unit 53 includes a microprocessor including a CPU. Temperature detection results of the temperature sensors 47 and 48 are input to the control unit 53, and the control unit 53 controls the temperature control unit 51. The temperature control unit 51 controls the temperature of the heater 42 and the moving mechanism 66. A method of the control of the temperature is as explained with reference to FIG. 5B. Specifically, the temperature control unit 51 controls the temperature of the heater 42 such that the toner temperature of the sheet S immediately after passing through the fixing device 38 reaches T1. And the temperature control unit 51 controls the moving mechanism 66 such that the temperature of the rubber rollers 44 approaches the toner temperature T2 of the sheet S passing through the conveying roller 39.

The control unit 53 controls the motor driving circuit 54. The motor driving circuit 54 controls the motor 55 to drive to rotate the heat roller 40 and the pressing roller 41 of the fixing device 38. The motor driving circuit 54 controls the motor 56 to drive to rotate the conveying roller 39. The motor driving circuit 54 controls the motor 57 to drive to rotate the heating belt 63.

In the second embodiment, since the rubber rollers 44 can be heated by using the heat of the heat roller 40, only one heat source has to be provided. The gloss of the printing surface of the sheet S is substantially equal over the entire surface. It is possible to suppress gloss unevenness.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A sheet conveying apparatus comprising:

a fixing device configured to heat, with a heat roller, a sheet having a toner image transferred thereon and fix a toner on the sheet;

a conveying roller arranged downstream of the fixing device and including plural rollers configured to convey the sheet from the fixing device;

a heating unit configured to heat the plural rollers of the conveying roller; and a temperature control unit configured to control temperature of the heating unit such that temperature of the plural rollers approaches toner temperature of the sheet passing through the conveying roller.

2. The apparatus of claim 1, wherein, when plural rows of the conveying rollers are present downstream of the fixing device, the heating unit heats at least the plural rollers of the conveying roller closest to the fixing device.

3. The apparatus of claim 1, wherein a pair of the plural rollers are arranged to be opposed to each other in the conveying roller, and the heating unit heats at least the plural rollers on a side set in contact with a surface of the sheet on which the toner is fixed.

4. The apparatus of claim 1, further comprising:

a first heater configured to heat the heat roller;

a first temperature sensor configured to detect temperature of the heat roller; and a second temperature sensor configured to detect temperature of the plural rollers, wherein the temperature control unit controls temperature of the first heater in response to a detection result of the first temperature sensor and controls temperature of the heating unit in response to a detection result of the second temperature sensor.

5. The apparatus of claim 4, wherein the temperature control unit calculates the toner temperature of the sheet passing through the conveying roller, on the basis of toner temperature of the sheet immediately after passing through the fixing device, and controls temperature of the heating unit such that the temperature of the plural rollers approaches the toner temperature of the sheet passing through the conveying roller, on the basis of the temperature detection result of the second temperature sensor.

6. The apparatus of claim 1, wherein the heating unit is a second heater configured to heat the plural rollers.

7. The apparatus of claim 1, wherein the heating unit includes:

a loop-shaped heating belt, one end of a loop of which is in contact with the plural rollers and the other end of the loop of which is provided near the heat roller; and a moving mechanism configured to move the other end of the loop of the heating belt close to and away from the heat roller.

8. The apparatus of claim 7, wherein the temperature control unit controls the moving mechanism to control temperature of the heating belt.

9. A sheet conveying method comprising:

providing a fixing device including a heat roller;

heating, with the heat roller, a sheet having a toner image transferred thereon and fixing a toner on the sheet;

arranging, downstream of the fixing device, a conveying roller including plural rollers;

conveying the sheet from the fixing device with the conveying roller;

heating the plural rollers of the conveying roller with a heating unit; and controlling temperature of the heating unit such that temperature of the plural rollers approaches toner temperature of the sheet passing through the conveying roller.

10. The method of claim 9, further comprising, when plural rows of the conveying rollers are present downstream of the fixing device, heating, with the heating unit, at least the plural rollers of the conveying roller closest to the fixing device.

11. The method of claim 9, further comprising:

arranging a pair of the plural rollers to be opposed to each other in the conveying roller, and heating, with the heating unit, at least the plural rollers on a side set in contact with a surface of the sheet on which the toner is fixed.

12. The method of claim 9, further comprising:

providing a first heater configured to heat the heat roller;

detecting temperature of the heat roller with a first temperature sensor;

detecting temperature of the plural rollers with a second temperature sensor;

controlling temperature of the first heater in response to a detection result of the first temperature sensor; and controlling temperature of the heating unit in response to a detection result of the second temperature sensor.

13. The method of claim 12, further comprising:

calculating the toner temperature of the sheet passing through the conveying roller, on the basis of toner temperature of the sheet immediately after passing through the fixing device; and controlling temperature of the heating unit such that the temperature of the plural rollers approaches the toner temperature of the sheet passing through the conveying roller, on the basis of the temperature detection result of the second temperature sensor.

14. The method of claim 9, wherein the heating unit is a second heater configured to heat the plural rollers.

15. The method of claim 9, wherein the heating unit includes a loop-shaped heating belt, one end of a loop of which is in contact with the plural rollers and the other end of the loop of which is provided near the heat roller, and the method further comprises moving, with a moving mechanism, the other end of the loop of the heating belt close to and away from the heat roller.

16. An image forming apparatus comprising:

a printer unit configured to transfer a toner image onto a sheet;

a fixing device configured to heat, with a heat roller, the sheet having the toner image transferred thereon by the printer unit and fix a toner on the sheet;

a conveying roller arranged downstream of the fixing device and including plural rollers configured to convey the sheet from the fixing device;

a heating unit configured to heat the plural rollers of the conveying roller; and a temperature control unit configured to control temperature of the heating unit such that temperature of the plural rollers approaches toner temperature of the sheet passing through the conveying roller.

17. The apparatus of claim 16, further comprising:

a first heater configured to heat the heat roller;

a first temperature sensor configured to detect temperature of the heat roller; and a second temperature sensor configured to detect temperature of the plural rollers, wherein the temperature control unit controls temperature of the first heater in response to a detection result of the first temperature sensor and controls temperature of the heating unit in response to a detection result of the second temperature sensor.

18. The apparatus of claim 17, wherein the temperature control unit calculates the toner temperature of the sheet passing through the conveying roller, on the basis of toner temperature of the sheet immediately after passing through the fixing device, and controls temperature of the heating unit such that the temperature of the plural rollers approaches the toner temperature of the sheet passing through the conveying roller, on the basis of the temperature detection result of the second temperature sensor.

19. The apparatus of claim 16, wherein the heating unit is a second heater configured to heat the plural rollers.

20. The apparatus of claim 16, wherein the heating unit includes:

a loop-shaped heating belt, one end of a loop of which is in contact with the plural rollers and the other end of the loop of which is provided near the heat roller; and a moving mechanism configured to move the other end of the loop of the heating belt close to and away from the heat roller, and the temperature control unit controls the moving mechanism to control temperature of the heating belt.

* * * * *